US005887507A

United States Patent [19]

Kaito

[11] Patent Number: 5,887,507

[45] Date of Patent: Mar. 30, 1999

[54] PLUNGER PUMP

[75] Inventor: Katsuaki Kaito, Nagaokakyo, Japan

[73] Assignee: Shimadzu Corporation, Kyoto, Japan

[21] Appl. No.: 958,315

[22] Filed: Oct. 27, 1997

[30] Foreign Application Priority Data

Oct. 29, 1996 [JP] Japan ..... 8-303935

[51] Int. Cl.[6] ..... F16J 1/10; F04B 19/00

[52] U.S. Cl. ..... 92/129; 417/470

[58] Field of Search ..... 92/129; 417/470

[56] References Cited

U.S. PATENT DOCUMENTS 3,118,381 1/1964 Keil ..... 92/129 X
4,583,921 4/1986 Wolff et al. ..... 417/539 X
5,100,305 3/1992 Zirps ..... 92/129 X
5,700,135 12/1997 Inokuchi et al. ..... 417/473 X

*Primary Examiner*—Hoang Nguyen
*Attorney, Agent, or Firm*—Armstrong, Westerman, Hattori, McLeland & Naughton

[57] ABSTRACT

In the inventive plunger pump, a plunger is pressed on a shaft by a spring via a thrust bearing having rolling elements clamped by a pair of bearing washers. By such a configuration, the motion of the shaft is immediately transmitted to the plunger, irrespective of whether the radius of the profile of a cam for driving the shaft back and forth is in the increment phase or decrement phase, so that the suction and discharge of liquid is performed without delay, since no play (or gap) exists in the transmission mechanism between the cam and the plunger. Thus, the fluctuation in the pressure is minimized during the operation of the pump and, when a low pressure gradient elusion is carried out, the solvents are supplied at the desired flow rates accurately.

8 Claims, 3 Drawing Sheets

PLUNGER PUMP

The present invention relates to a plunger pump for pumping a liquid with high accuracy, such as used in a liquid chromatograph, etc.

BACKGROUND OF THE INVENTION

FIG. 2 shows a conventional plunger pump 10 including a pump head 11 and a pump body 12 which are connected to each other via a connector part 13. In the pump head 11, a cylindrical passage is formed, which is referred to as a cylinder 15, wherein a plunger 16 is inserted. Further, a suction passage 17 and a discharge passage 18, both connected to the cylinder 15, are provided in the pump head 11, and a suction check valve 19 and a discharge check valve 20 are disposed in the above passages, respectively.

The plunger 16 extends through the connector part 13 into the pump body 12, where the rear end of the plunger 16 is fixed to a plunger holder 21 having a diameter larger than that of the plunger 16. The plunger holder 21 is accommodated in a cavity formed at the front end of a shaft 22 which can move back and forth in the pump body 12, where the plunger holder 21 is held at its front and rear ends. The front and rear ends of the plunger holder 21 are spherical, whereas the inner face of the cavity for retaining the rear end of the plunger holder 21 is flat. Thus, even when the plunger 16 is held in the cavity, it still has a degree of freedom, Ftr, to move transversely, i.e. in the direction vertical to the central axis, and another degree of freedom, Fro, to rotate, or swivel.

The shaft 22 is driven back and forth by a cam 25 and a spring 26, where the shaft 22 is regulated by a cam follower 27 provided at the rear end of the shaft 22 and a bearing 28 provided in the pump body 12 so that it can move only in the direction of its axis.

The space between the front part of the plunger 16 and the pump head 11 and the space between the rear part of the plunger 16 and the connector part 13 are sealed by seals 30 and 31, respectively. Leakage of a liquid from the cylinder 15 is prevented by the seal 30, and leakage of the a plunger-washing liquid, which is supplied through a plunger-washing passage 32 when necessary, is prevented by the seals 30 and 31.

Since the plunger 16 is held by the two seals 30, and 31 at its front and rear parts, respectively, the plunger 16 is bound to move on the straight line passing through both the centers of the seals 30 and 31. On the other hand, the shaft 22 is bound to move in the direction of the axis determined by the bearing 28 as described above. In assembling the plunger pump 10, the axis of the plunger 16 and the axis of the shaft 22 may be displaced transversely from each other and/or inclined to each other. In these cases, not only the plunger 16 moves incorrectly, but also such an excessive force may be transmitted to the seals 30 and 31 that results in damage to the seals. In view of this, the contacting part of the plunger 16 (i.e. its rear end) is shaped spherical while the contacting part of the shaft 22 (i.e. the inner face of the cavity of the shaft 22) is flat, so that the degrees of freedom for the plunger 16 to move in the traversal direction and to rotate, Ftr and Fro, are provided as described above.

When the plunger holder 21 is set in the cavity of the shaft 22, a small gap of about several tens of $\mu$m is left at the front and/or rear ends of the plunger holder 21, so that the plunger 16 has the degrees of freedom in motion and rotation as described above. Due to the gap, however, a time lag occurs between the motion of the plunger 16 and the actual suction and discharge of liquid by the pump 10, which causes various problems such that the pumping pressure fluctuates during the pumping operation, for example. Particularly, when a low pressure gradient elusion is carried out, the flow rates of solvents pumped out by different pumps, respectively, cannot be regulated correctly, so that the actual concentration of the mixture of the solvents at a time point cannot be equal to an objective concentration predetermined corresponding to the time point.

When the pump 10 is assembled, a small displacement or inclination is allowed between the axis of the plunger 16 and the axis of the shaft 22, as described above. Here, however, the inclination between the two axes prevents the shaft 22 and the plunger 16 from moving smoothly during the operation of the pump 10. The reason is explained as follows. Referring to FIG. 3, when the shaft 22 thrusts the plunger holder 21 with its axis 52 being inclined to the axis 53 of the plunger 16, the contacting point where the flat end of the shaft 22 contacts with the spherical end of the plunger holder 21, moves from the point P0 to the point P1. When the contacting point moves, an excessive, force is worked on the seals 30 and 31 by the plunger 16 due to the friction between the shaft 22 and the plunger holder 21, which may cause damage to the seals 30 and 31 and/or leakage of the liquid.

SUMMARY OF THE INVENTION

The present invention is completed in view of the above problems, an object of which is to propose a plunger pump designed so that the play of the plunger is reduced to improve the accuracy in pumping a liquid and, further, the friction between the plunger holder and the shaft is reduced to prevent an excessive force from working on component members in the pump.

Thus, in a plunger pump which includes:

a) a shaft driven back and forth by a cam; and b) a plunger pressed on the shaft by a spring and driven back and forth in a cylinder by the shaft; the plunger pump according to the present invention is characterized in that:

c) the plunger is pressed on the shaft via a thrust bearing including rolling elements clamped by bearing washers having no raceway groove.

In the inventive plunger pump, the plunger is pressed on the shaft by the spring via the thrust bearing. By such a structure, the motion of the shaft is immediately transmitted to the plunger irrespective of whether the radius of the cam profile is in the increment phase or decrement phase, so that the suction and discharge of liquid is performed without delay, since no play (or gap) exists in the transmission mechanism between the cam and the plunger. Thus, the fluctuation in the pressure is minimized during the operation of the pump and, when a low pressure gradient elusion is carried out, the solvents are supplied at desired flow rates accurately.

A thrust bearing normally includes a pair of bearing washers and several rolling elements clamped therein, where the rolling elements are balls, rollers, etc. In the inventive plunger pump, the thrust bearing is disposed at least between the shaft and the plunger, and the rolling elements of the thrust bearing are preferably balls. It is further preferable to dispose another thrust between the spring and the plunger.

In the thrust bearing used in the inventive plunger pump, the rolling elements are clamped by the bearing washers having no raceway groove for regulating the rolling elements to be in a predetermined path or at predetermined positions. By such a structure, not only the axis of the shaft and the axis of the plunger are allowed to displace transversely from each other, but also the axes are allowed to be inclined to each other even when there is no play in the transmission mechanism, since the friction between the shaft and the plunger (or plunger holder) is minimized by the thrust bearing, so that an excessive force is prevented from working on a seal or the like.

DETAILED DESCRIPTION OF A PREFERRED EMBODIMENT

Figure 1:
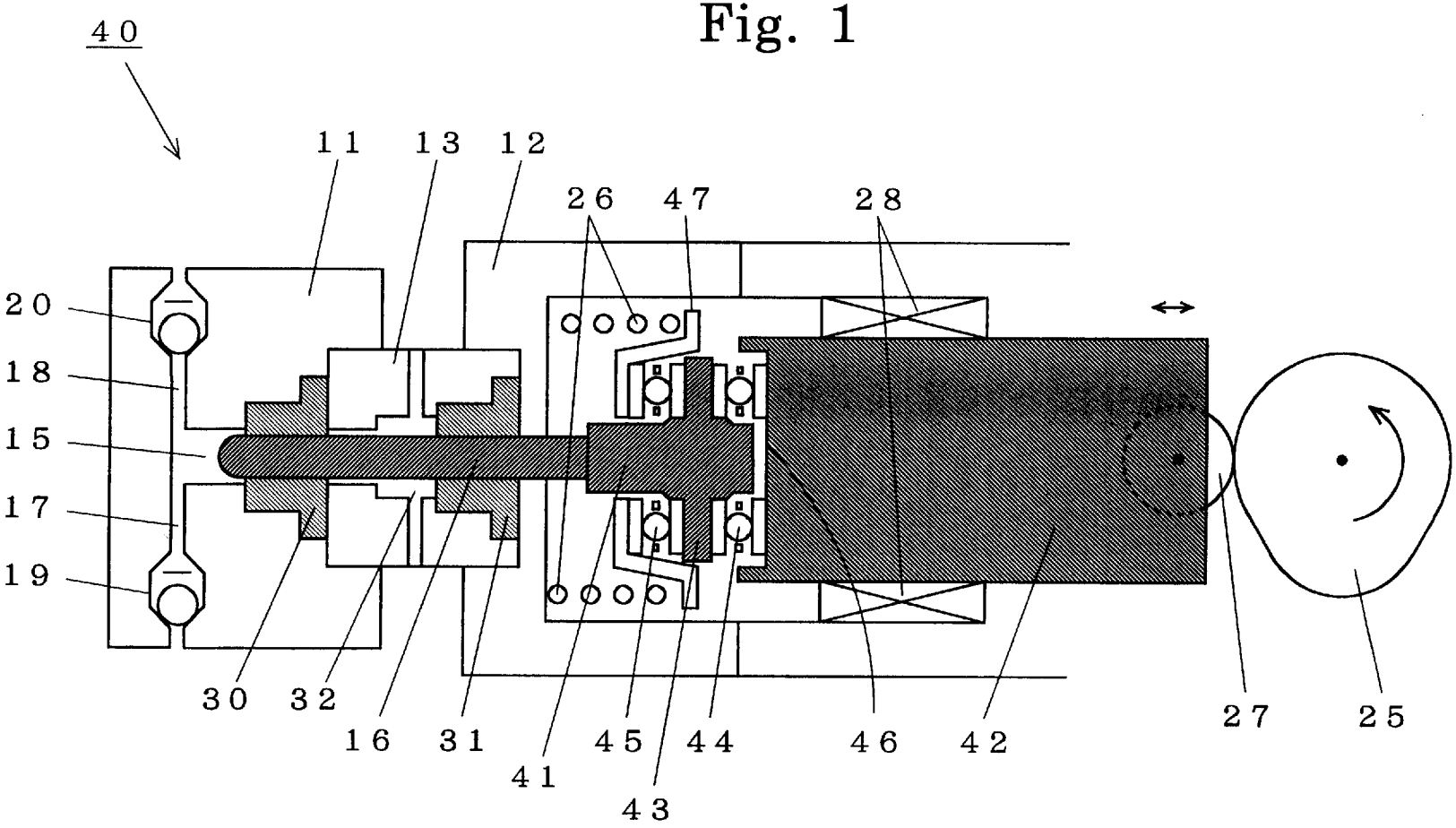
FIG. 1 is a cross section of a plunger pump according to the present invention.
Figure 2:
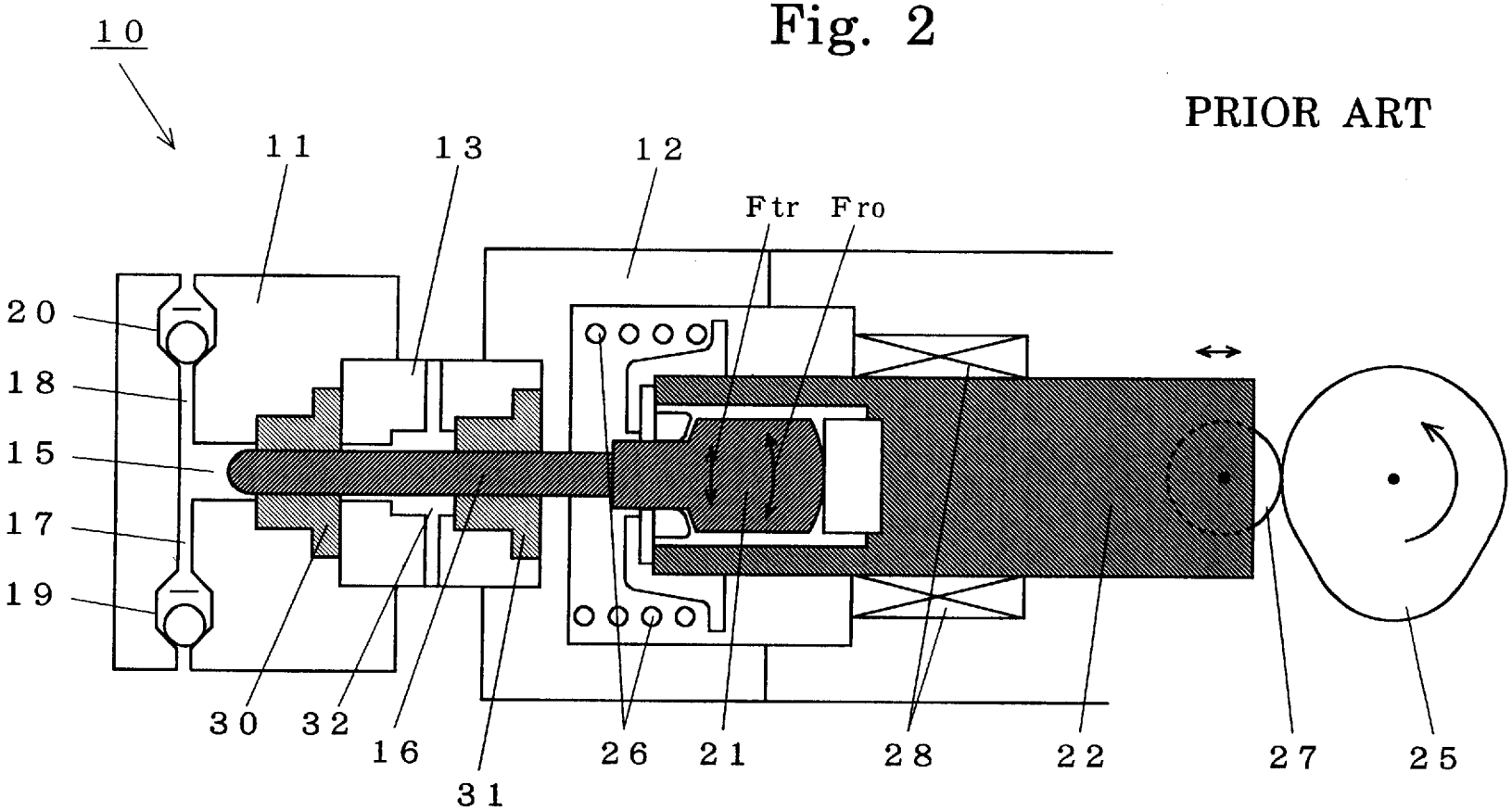
Fig. 2 PRIOR ART
FIG. 2 is a cross section of a conventional plunger pump.
Figure 3:
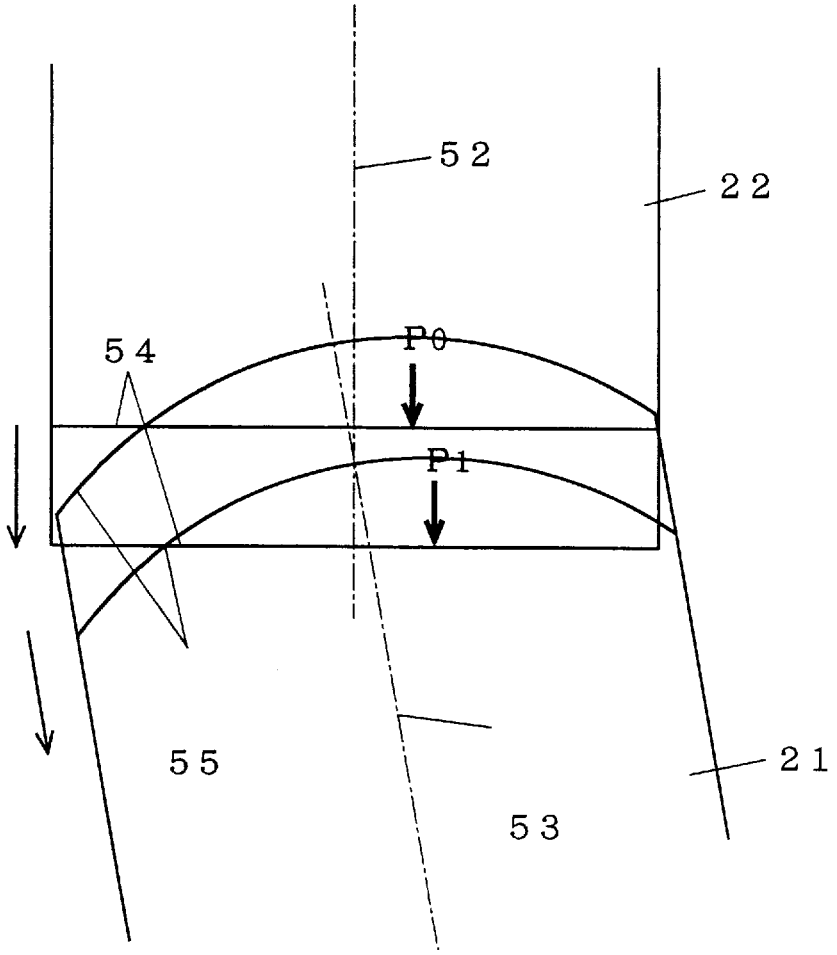
Fig. 3 PRIOR ART
FIG. 3 is an illustration showing part of the conventional plunger pump where the axis of the shaft is inclined to the axis of the plunger.

Referring to FIG. 1, a plunger pump according to the present invention is described as follows. The basic structure of the plunger pump 40 shown in FIG. 1, which is an embodiment of the present invention, is the same as that of the conventional plunger pump 10 shown in FIG. 2, and the elements that are commonly used in both of the plunger pumps in FIGS. 1 and 2 are denoted by the same numerals.

The plunger pump 40 is characterized by the structure for connecting a plunger holder 41 and a shaft 42. In detail, the plunger holder 41 has a disk-shaped flange 43 extending outward and vertical to the axis of the plunger 16. The flange 43 is clamped from both sides, via the thrust ball bearings 44 and 45, by the end of the shaft 42 and a holding member 47 pressed by the spring 26. In each of the thrust ball bearings 44 and 45, the bearing washers in pairs can change its relative position with respect to each other freely in the transverse direction (i.e. in the direction parallel to the face of the bearing washers or the direction vertical to the axis of the shaft 42 or the plunger 16), since the bearing washers have no raceway groove for regulating the balls to move in a predetermined path.

In the plunger pump 40 of the present embodiment, the plunger holder 41 is pressed via the thrust ball bearings 44 and 45 on the end of the shaft by the spring 26. By such a structure, the suction and discharge is performed without delay, since no play (or gap) exists in the transmission mechanism between the cam 25 and the plunger 16. Besides, the bearing washers in pairs in each of the thrust ball bearings 44 and 45 can change its relative position with respect to each other freely in the transverse direction. Therefore, even when the axis of the shaft 42 and the axis of the plunger 16 are displaced from each other, the plunger pump 40 can be assembled without a problem and the shaft 42 and the plunger 16 can move smoothly during the operation of the plunger pump 40. In addition, when the component members of the plunger pump 40 are manufactured using the current manufacturing technology, the inclination between the axis of the shaft 42 and the plunger 16 in the assembled state is normally very small so that the thrust ball bearings 44 and 45 can be assembled without a problem, and the excessive force is prevented from being exerted on the seals 30 and 31 during the operation of the plunger pump 40.

What is claimed is:

1. A plunger pump comprising:

a) a shaft driven back and forth by a cam; and b) a plunger pressed on the shaft by a spring and driven back and forth in a cylinder by the shaft, wherein the plunger is pressed on the shaft via a thrust bearing including rolling elements clamped by bearing washers having no raceway groove.

2. The plunger pump according to claim 1, wherein the rolling elements are balls.

3. The plunger pump according to claim 1, wherein the plunger has a flange retained by the shaft via the thrust bearing.

4. The plunger pump according to claim 2, wherein the plunger has a flange retained by the shaft via the thrust bearing.

5. The plunger pump according to claim 1, comprising another thrust bearing disposed between the spring and the plunger.

6. The plunger pump according to claim 2, comprising another thrust bearing disposed between the spring and the plunger.

7. The plunger pump according to claim 3, comprising another thrust bearing disposed between the spring and the plunger.

8. The plunger pump according to claim 4, comprising another thrust bearing disposed between the spring and the plunger.

* * * * *